US009385477B2

(12) United States Patent
De Geest

(10) Patent No.: US 9,385,477 B2
(45) Date of Patent: Jul. 5, 2016

(54) HIGH SPEED EDGE CARD CONNECTOR

(75) Inventor: Jan De Geest, Wetteren (BE)

(73) Assignee: FCI, Guyancourt (FR)

( * ) Notice: Subject to any disclaimer, the term of this patent is extended or adjusted under 35 U.S.C. 154(b) by 216 days.

(21) Appl. No.: 13/993,438

(22) PCT Filed: Dec. 13, 2011

(86) PCT No.: PCT/IB2011/003259
§ 371 (c)(1),
(2), (4) Date: Jul. 29, 2013

(87) PCT Pub. No.: WO2012/080843
PCT Pub. Date: Jun. 21, 2012

(65) Prior Publication Data

US 2013/0309906 A1 Nov. 21, 2013

(30) Foreign Application Priority Data

Dec. 13, 2010 (WO) ..... PCT/IB2010/003415

(51) Int. Cl.
*H01R 12/00* (2006.01)
*H01R 13/646* (2011.01)
*H01R 13/6477* (2011.01)
*H01R 12/72* (2011.01)

(52) U.S. Cl.
CPC ..... *H01R 13/646* (2013.01); *H01R 13/6477* (2013.01); *H01R 12/721* (2013.01)

(58) Field of Classification Search
CPC . H01R 13/646; H01R 13/6477; H01R 12/721
USPC ..... 439/79, 55, 607.35–607.4
See application file for complete search history.

(56) References Cited

U.S. PATENT DOCUMENTS 4,641,222 A * 2/1987 Derfiny ..... H05K 1/0271 174/255
6,064,576 A * 5/2000 Edwards ..... H01L 23/13 174/260
6,296,496 B1 10/2001 Trammel ..... 439/79

(Continued)

FOREIGN PATENT DOCUMENTS

EP 2 149 942 A1 2/2010
JP 2006-236858 9/2006
TW 201117685 A 5/2011
TW M-408853 U 8/2011
WO WO-2013/055567 A2 4/2013

OTHER PUBLICATIONS

"Cinch High Speed Cables", Cinch, published Mar. 2011, 7 pgs.

(Continued)

*Primary Examiner* — Khiem Nguyen
(74) *Attorney, Agent, or Firm* — Harrington & Smith

(57) ABSTRACT

A connector for connection between a circuit board and a further electronic component is disclosed. The connector includes an insulating housing having a board slot open towards a mating direction for accommodating the circuit board, and a plurality of terminals. The terminals have a rear portion, an intermediate portion and a tip portion, the intermediate portion including a contact portion for contacting a surface portion of the circuit board when accommodated in the board slot. The housing includes a window such that for a number of adjacent terminals housing material is absent between the intermediate portions. A shield member may be arranged in between the rear portions of the terminals. Improved circuit boards are also disclosed.

13 Claims, 8 Drawing Sheets

(56) References Cited

U.S. PATENT DOCUMENTS

| | | | | |
|---|---|---|---|---|
| 7,557,303 | B2 * | 7/2009 | Tang | H05K 1/024 174/255 |
| 7,595,999 | B2 * | 9/2009 | Wu | H05K 1/0271 361/760 |
| 8,270,180 | B2 * | 9/2012 | Liu | H05K 1/0251 174/262 |
| 2004/0077221 | A1 | 4/2004 | Peloza et al. | 439/676 |
| 2010/0075536 | A1 | 3/2010 | Kubo | 439/620.21 |

OTHER PUBLICATIONS

INF-84381, Rev. 1.0, "QSFP (Quad Small Formfactor Pluggable) Transceiver", Nov. 2006, Chapter 4: Mechanical and Board Definition, pp. 22-38.

* cited by examiner

HIGH SPEED EDGE CARD CONNECTOR

TECHNICAL FIELD

The present disclosure relates to the field of electrical connectors, in particular card connectors, more in particular high speed edge card connectors.

BACKGROUND

In the art of electrical devices, there are continuous trends towards faster signal transmission speeds and miniaturisation. Thus, connectors are desired meeting this trend. However, with miniaturisation of connectors, problems of signal integrity and noise, as well as mechanical stability and robustness of the connector increase, while complexity and costs for manufacture may increase as well.

The present disclosure aims to address one or more of these problems in the particular fields of circuit card connections and edge card connectors, where high data transmission speeds of well over 2 Gbit/second, e.g. 10 or 15 Gbit/second or even higher preferably should be achieved.

SUMMARY

In an aspect, a connector for connection between a circuit board and a further electronic component is provided. The connector comprises an insulating housing having a board slot open towards a mating direction for accommodating the circuit board, and a plurality of terminals. The terminals have a rear portion, an intermediate portion and a tip portion, the intermediate portion comprising a contact portion having a surface contacting contact for contacting a surface portion of a circuit board when that is accommodated in the board slot. Each terminal is supported in a terminal slot in the housing, the contact portions of the terminals protruding from the housing into the board slot, the terminals being arranged substantially parallel each other forming a row of the contacts substantially perpendicular to the mating direction. The housing comprises a window such that for a number of adjacent terminals housing material is absent between the intermediate portions.

Thus, the amount of dielectric material of the housing, typically a plastic material, inbetween the intermediate portions of the terminals is replaced by air. This increases impedance of the terminals reducing losses and increasing the achievable data transmission speed.

In an aspect, a connector for connection between a circuit board and a further electronic component is provided, e.g. a connector as described above, which comprises an insulating housing having a board slot open towards a mating direction for accommodating the circuit board, and a plurality of first terminals and a plurality of second terminals. The first and second terminals have a rear portion, an intermediate portion and a tip portion, the intermediate portion comprising a contact portion having a surface contacting contact for contacting a surface portion of a circuit board accommodated in the board slot. Each of the first and second terminals is supported in the housing, the contact portions of the first terminals protruding from the housing into the board slot from a first side, the contact portions of the second terminals protruding from the housing into the board slot from a second side opposite the first side. The first terminals are arranged substantially parallel each other forming a row of the contacts substantially perpendicular to the mating direction and the second terminals are arranged substantially parallel each other forming a row of the contacts substantially perpendicular to the mating direction. The rear portions of the first terminals are spatially separated from the rear portions of the second terminals. At least one shield member is arranged inbetween the rear portions of the first terminals and the rear portions of the second terminals.

In such connector, the first and second terminals are shielded from each other. This reduces cross talk between first and second terminals. Further, circuit boards tend to have plural layers (i.e. be multilayer circuit boards) comprising one or more ground layers wherein large portions or substantially the entire area of the circuit board is covered with a conductive material, e.g. a metal. This shields traces arranged on layers opposite such ground layers. With a connector comprising a shield member in between opposite terminals impedance of the terminals or signal transmission lines through the connector may be matched closely to a desired impedance and in particular to an impedance of the circuit board. Thus, signal quality may be further improved.

In such connector, at least a portion of at least one of the first terminals and the second terminals may be connected to the at least one shield member. This ensures maintenance of equal voltages on the connected terminals and the at least one shield member. Further, the position of the connection(s) between the connected terminals and the at least one shield member may be chosen to correspond to a predetermined fraction of a noise resonance wavelength, so that standing waves at such noise resonance wavelength are reduced or prevented. Thus, specific noise frequencies may be damped or removed.

In aspect, a circuit board is provided, e.g. for use with a connector described above, which comprises a plurality of signal conductor traces and a plurality of ground traces, a first edge towards a mating side and a circuit board connector portion adjacent the first edge. The circuit board connector portion comprises signal contact pads for contacting the signal conductor traces by contacts of a mating connector and ground contact pads for contacting the ground traces by contacts of the mating connector. The signal contact pads are separated from the first edge of the circuit board by a first distance and the ground contact pads are separated from the first edge of the circuit board by a second distance which is smaller than the first distance. Inbetween the signal contact pads and the first edge the circuit board comprises one or more further contact pads which are insulated from the signal contact pads and which are separated from the first edge of the circuit board by a third distance, preferably substantially equal to the second distance.

Such circuit board provides a first make—last break contact to the ground contacts when inserted into (retracted from) a connector having a row of contacts for contacting the signal and ground contact pads, since the ground contact pads will make (maintain) physical and electrical contact to the connector contacts before (after) the signal contact pads. The further contact pads inbetween the signal contact pads and the first edge provide a variation in the physical contact force and friction force of the connector contacts to the board material, thus affecting the mating force required when mating the circuit board to a circuit board connector. The relationship between the second and third distances modifies the mating force profile, i.e. the variation of the required force for mating with insertion depth of the circuit card and the mating connector. Also, the further contact pads affect the impedance of the signal contact pads, which may therefore be adapted to a desired value.

In case the further contact pads and the ground contact pads are of substantially the same material, advantageously of the same material of the signal contact pads, the mating force is substantially constant during (un)mating of the circuit board and a suitable connector. This improves user friendliness and may reduce wear on the circuit board and the connector.

The further contact pads may be electrically floating, so as to maintain the first make—last break structure, or connected to ground when the circuitry connected to the connector allows that.

In an aspect, a multilayered circuit board is provided comprising a plurality of signal conductor traces, a plurality of ground traces and one or more ground layers. In at least a first portion of the circuit board at least a portion of the signal conductor traces and the ground traces being arranged adjacent each other, advantageously also substantially parallel to each other. In the first portion of the circuit board the ground traces are connected to at least one ground layer with a plurality of adjacent conductive vias.

This ensures maintenance of equal voltages on the connected terminals and the at least one ground layer. It further provides shielding of the signal conductor traces due to the provision of ground conductors aside the traces also in different orientations and positions than the layer structure otherwise present in circuit boards. Also, impedance matching of the signal transmission lines to that at another portion of the circuit board may be facilitated.

In the first portion of the circuit board the adjacent signal conductor traces and ground traces may be arranged on a common layer of the circuit board. This provides improved shielding in the layer comprising the signal and ground traces.

The first portion of the circuit board may comprise a circuit board connector portion, in turn comprising signal contact pads for contacting the signal conductor traces by contacts of a mating connector and ground contact pads for contacting the ground traces by contacts of the mating connector. In particular in such case improved impedance matching and shielding by the plurality of vias is beneficial, all the more so when the signal traces penetrate into the board by signal routing vias and then continue on an embedded layer; the vias may then effectively form shielding bars and/or impedance matching portions around the signal routing vias.

Further, at least a portion of the vias may be separated by a mutual distance which corresponds to a predetermined fraction of a noise resonance wavelength, so that standing waves at such noise resonance wavelength are reduced or prevented. Thus, specific noise frequencies may be damped or removed.

The mutual separation of the vias may vary along the adjacent and parallel signal conductor traces and ground traces, e.g. to provide a gradual change in the impedance from one portion of the circuit board to the next, to provide a spatially varying shielding, and/or to dampen or prevent one or more noise resonance wavelengths in particular positions.

In an aspect, a multilayered circuit board is provided comprising a plurality of signal conductor traces and one or more ground layers, and a circuit board connector portion, in turn comprising signal contact pads for contacting the signal conductor traces by contacts of a mating connector. In the board, at least one ground layer comprises a window at the circuit board connector portion surrounding at least one signal contact pad when viewed normal to the ground layer.

Such board reduces capacitive effects of the ground layer adjacent the contact pads, therewith improving impedance for the contacts.

At least one ground layer may comprise a window at the circuit board connector portion surrounding a plurality of signal contact pads when viewed normal to the ground layer. This reduces crosstalk between signal conductor traces, in particular the signal contact pads, improving signal integrity.

The circuit board may be a mother card, a daughter card or part of a card connector.

These and other aspects will hereafter be more explained with further details and benefits with reference to the drawings showing embodiments of the invention by way of example.

DETAILED DESCRIPTION OF EMBODIMENTS

Figure 3:
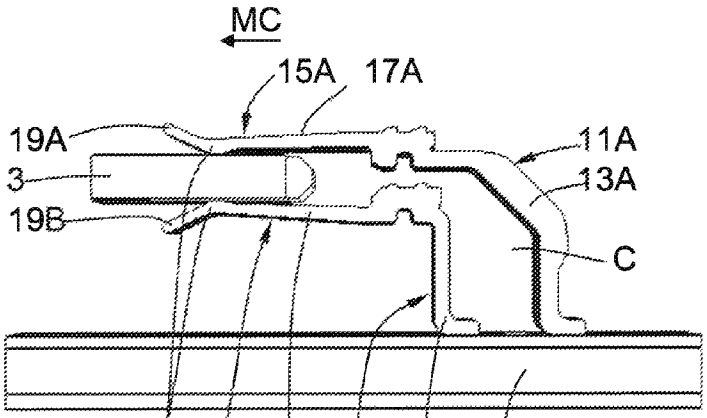
FIGS. 3-4 are side and rear views, respectively of the connector of FIGS. 1-2, with a connector housing omitted.
Figure 4:
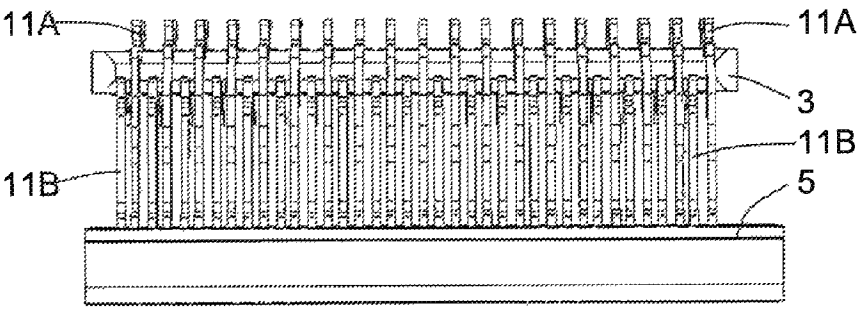
Figure 1:
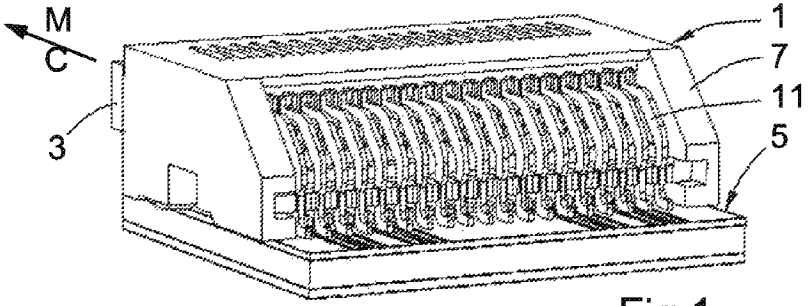
FIGS. 1-2 are perspective views of an edge card connector connected with a card portion.
Figure 2:
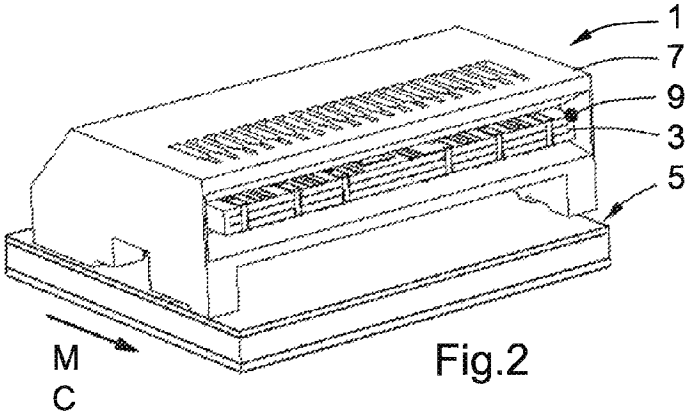

It is noted that the drawings are schematic, not necessarily to scale and that details that are not required for understanding the present invention may have been omitted. The terms "upward", "downward", "below", "above", and the like relate to the embodiments as oriented in the drawings, unless otherwise specified.

Further, elements that are at least substantially identical or that perform an at least substantially identical function are denoted by the same numeral, where useful such elements are individualised by an alphabetic suffix, e.g. first terminals 11A and second terminals 11B may be generally denoted as "terminals 11".

FIGS. 1-4 show (portions of) an edge card connector 1 for connection between a circuit board 3 or contact card and a further electronic component, here another circuit board 5. The connector 1 comprises an insulating housing 7 having a board slot 9 open towards a mating direction MC of the connector for accommodating the circuit board 3, and a plurality of first terminals 11A a plurality of second terminals 11B. The terminals 11A, 11B, each have a rear portion 13A, 13B, and a cantilever arm 15A, 15B providing an intermediate portion 17A, 17B and a tip portion 19A, 19B. The generally opposing cantilever arms 15A, 15B first converge and then diverge with the tip portions 19A, 19B in the mating direction MC. The rear portions 13A of the first terminals 11A are spatially separated from the rear portions 13B of the second terminals 11B, providing an open channel C between them in side view (FIG. 3). Here, the connector 1 is a right-angle board connector and the channel C extends parallel to the board 5 and perpendicular to the mating direction MC.

The intermediate portions 17A, 17B comprise a contact portion 21A, 21B having a surface contacting contact for contacting a surface portion of a circuit board 3 when that is accommodated in the board slot 9 (best seen in FIG. 3).

The contact portions 21A of the first terminals 11A protrude from the housing 7 into the board slot 9 from a first side, here the upper side, the contact portions 21B of the second terminals 11B protrude from the housing 7 into the board slot 9 from a second side opposite the first side, here the bottom side. The first terminals 11A are arranged substantially parallel each other forming a row of contacts substantially perpendicular to the mating direction MC. Likewise, the second terminals 11B are arranged substantially parallel each other forming a row of contacts substantially perpendicular to the mating direction MC.

At least a portion of the connector 1 may be surrounded by a conductive shield (not shown).

Figure 5:
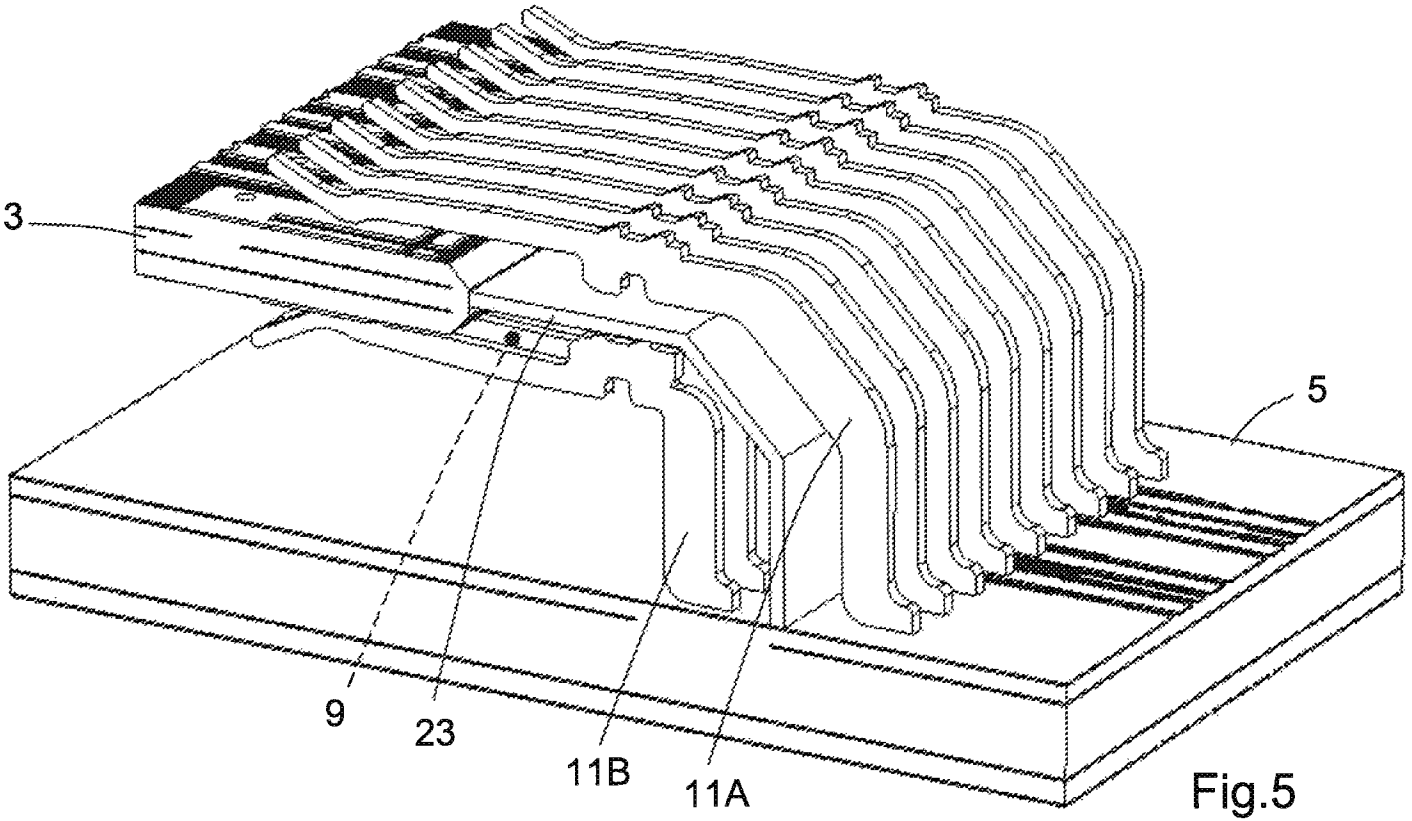
FIG. 5 is a perspective views of another edge card connector connected with a card portion.
Figure 6:
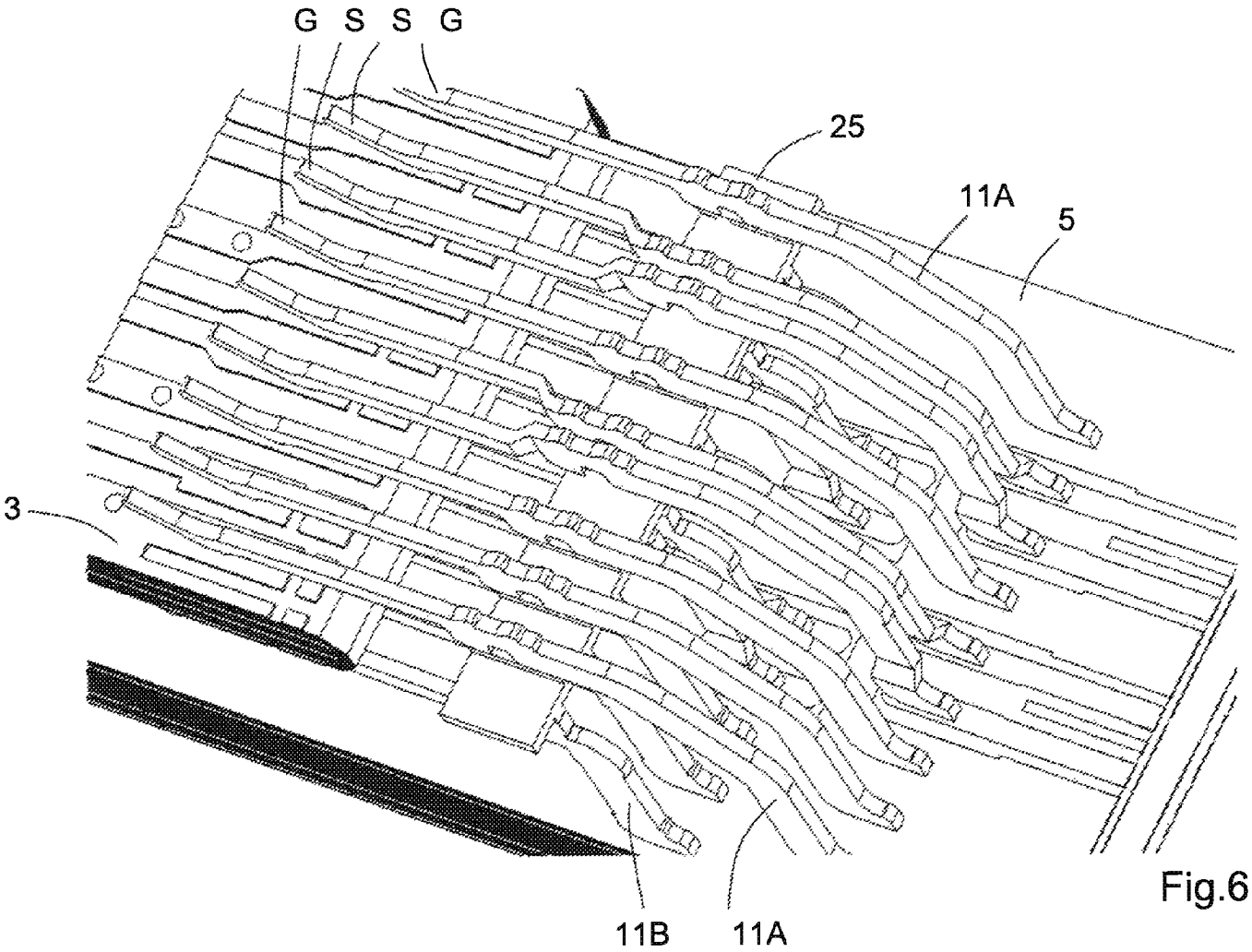
FIG. 6 is a perspective views of a further edge card connector connected with a card portion.

FIGS. 5-6 show different embodiments of a connector 1, in which a shield member 23 and 25, respectively, is arranged in a channel C inbetween the rear portions 13A of the first terminals 11A and the rear portions 13B of the second terminals 11B.

The shield 23 of FIG. 5 is bent, following the general shape of (the rear portions 13A, 13B of) the terminals 11A, 11B substantially fully from (a board 3 in) the board slot 9 to the circuit board 5.

The shield 25 of FIG. 6 is substantially plane and extends only along a portion of the terminals 11A, 11B. The shield 25 is connected to some of the first and second terminals 11A, 11B. The position of the connections of the terminals 11A, 11B and the shield 25 is selected within, but not halfway, the lengths of the terminals 11A, 11B between, on the one side, the connection of the terminals 11A, 11B to the board 5 and, on the other side, the contact portion 21A, 21B of the terminals 11A, 11B. Due to such position, standing waves with wavelengths corresponding to the physical and/or electrical lengths between, on the one side, the connection of the terminals 11A, 11B to the board 5 and, on the other side, the contact portion 21A, 21B of the terminals 11A are substantially prevented.

Further, in FIGS. 5 and 6 a portion of the terminals 11 are arranged in a Ground (G)—Signal (S)—Signal (S)—Ground (G) geometry for differential signal transmission with the rear portions 13 of the signal terminals (S, S) being bent towards each other for increasing broad side coupling.

Figure 7:
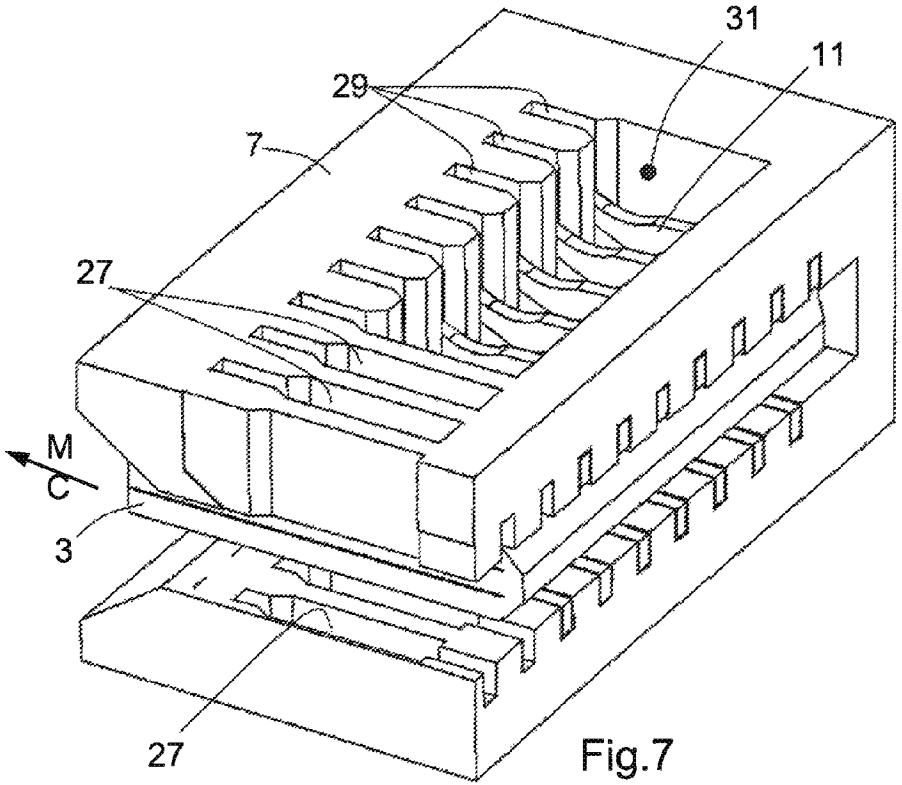
FIG. 7 is a perspective view of a portion of an edge card connector connected with a card portion.

FIG. 7 shows a portion of a housing 7' of a connector. In FIG. 7 is visible that each terminal 11, is supported in a terminal slot 27, 29 in the housing. The contact portions 21 of the terminals 11 protrude from the housing 7' into the board slot 9 (not visible). The terminals 11 are arranged substantially parallel each other with their contact portions 21 forming a row of contacts substantially perpendicular to the mating direction MC.

The slots 27 are separated by dielectric material of the housing 7' so that the terminals 11 received therein are insulated by that dielectric material. The housing 7' further comprises a window 31 in which the dielectric housing material is absent. The slots 29 are divided by the window 31, so that the terminals 11 received in the slots 29 are not insulated by the dielectric housing material but rather by the material filling the window 31, which is air in the shown embodiment.

As shown in FIG. 7, the connector may comprise a mixture of fully surrounded slots 27 and slots 29 interrupted and interconnected by a window 31, or put differently, a mixture of neighbouring terminals 11 insulated by housing material and neighbouring terminals 11 insulated by a different material, e.g. air. In general terms the higher the dielectric constant of the insulating material, the higher the impedance of the terminal 11.

Figure 8:
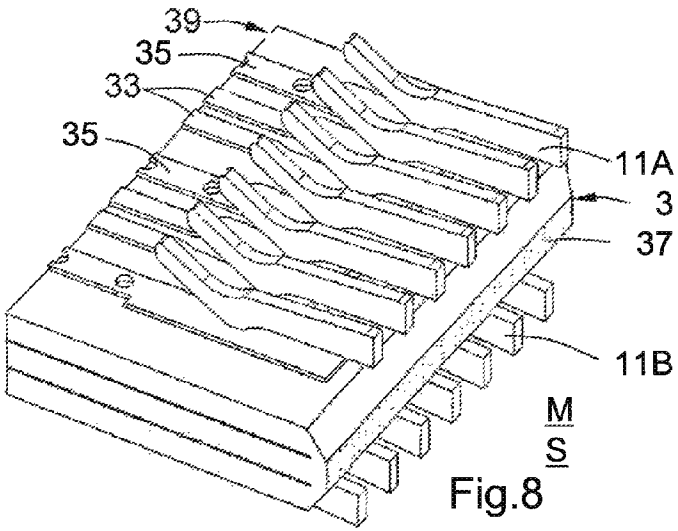
FIG. 8 is a perspective view of the edge card connector connected with a card portion of FIG. 8, with a connector housing omitted.
Figure 9:
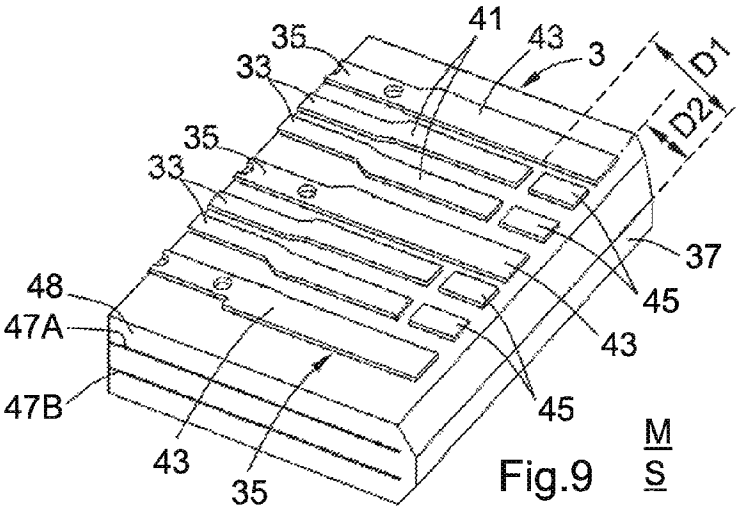
FIG. 9 shows an embodiment of an edge card.
Figure 10A:
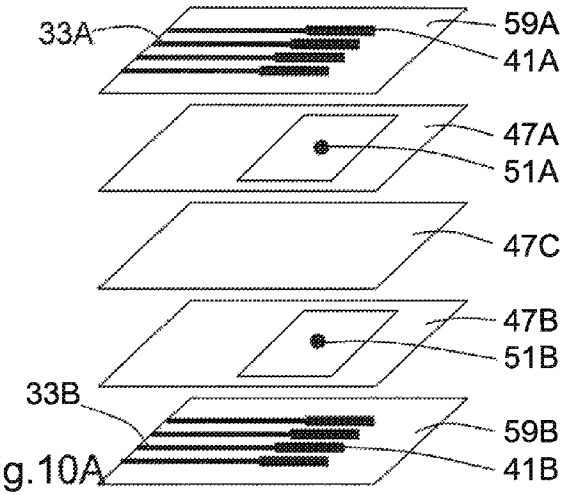
FIG. 10A is a perspective view of another embodiment of the conductive portions of an edge card.
Figure 11:
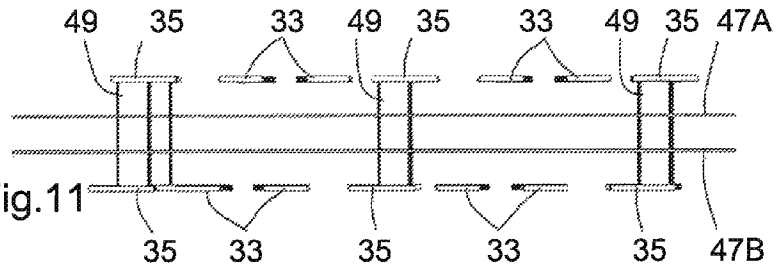
FIG. 11 is a front view of the conductive portions of the edge card of FIG. 9 as indicated in FIG. 10 with XI.
Figure 12:
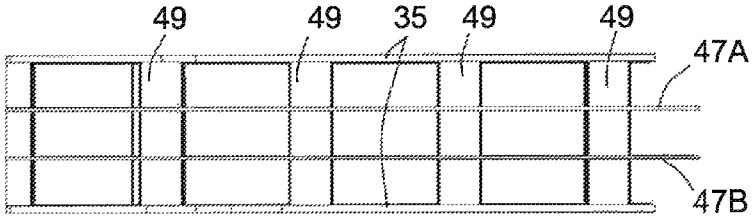
FIG. 12 is a side view of the conductive portions of the edge card of FIG. 9 as indicated in FIG. 10 with XII.
Figure 10:
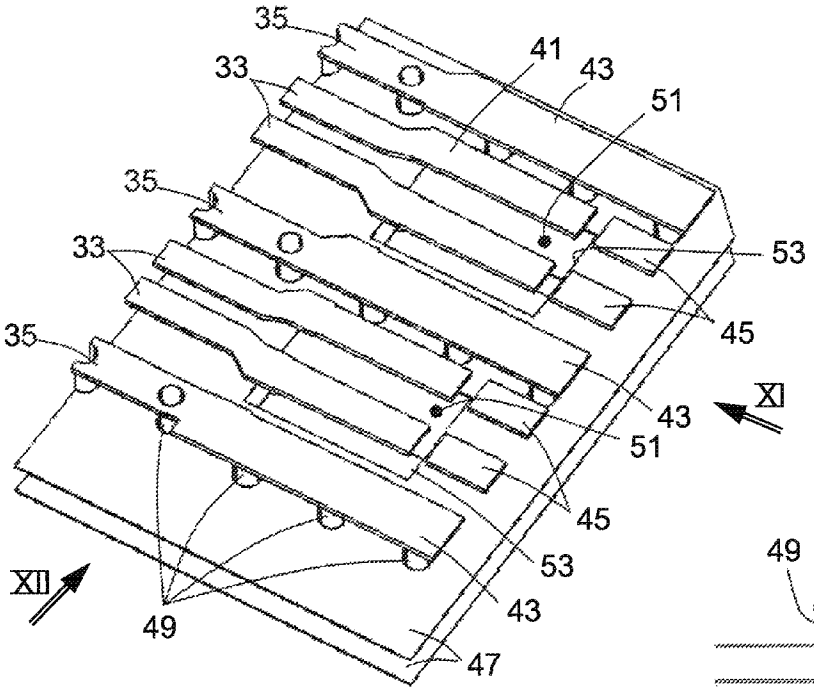
FIG. 10 is a perspective view of the conductive portions of the edge card of FIG. 9.
Figure 14:
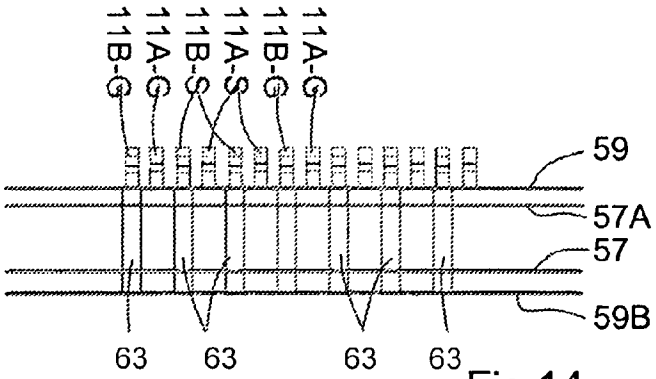
FIG. 14 is a front view of the conductive portions of the circuit board of FIG. 13 as indicated in FIG. 13 with XIII.
Figure 15:
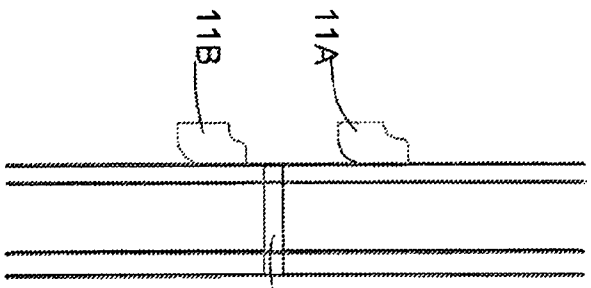
FIG. 15 is a side view of the conductive portions of the circuit board of FIG. 13 as indicated in FIG. 13 with XIV.
Figure 13:
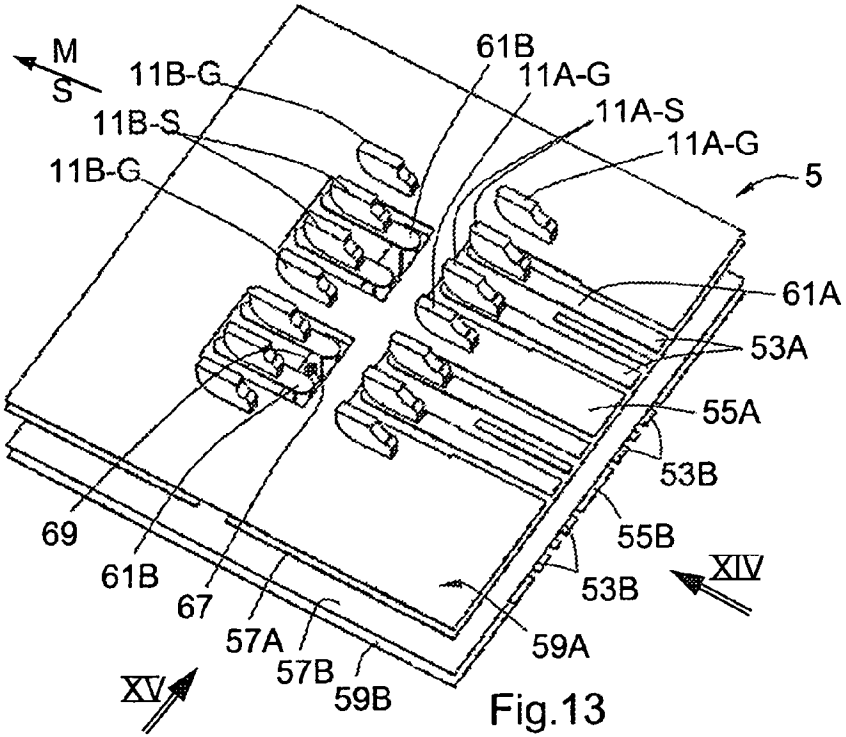
FIG. 13 is a perspective view of the conductive portions of a circuit board.
Figure 17:
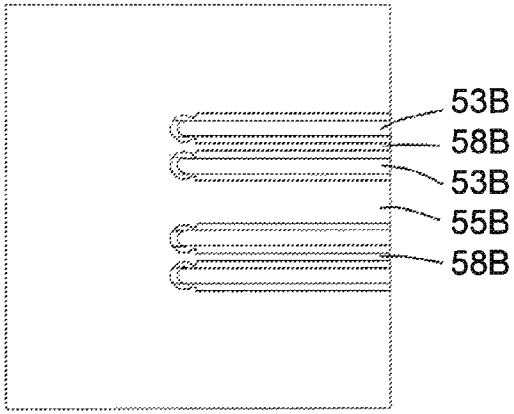
FIG. 17 is a bottom view of the conductive portions of the circuit board of FIG. 13.
Figure 16:
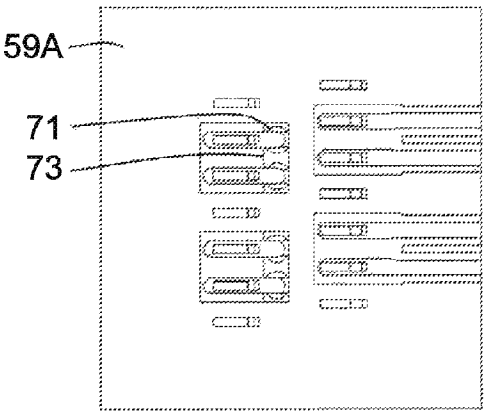
FIG. 16 is a top view of the conductive portions of the circuit board of FIG. 13.
Figure 22:
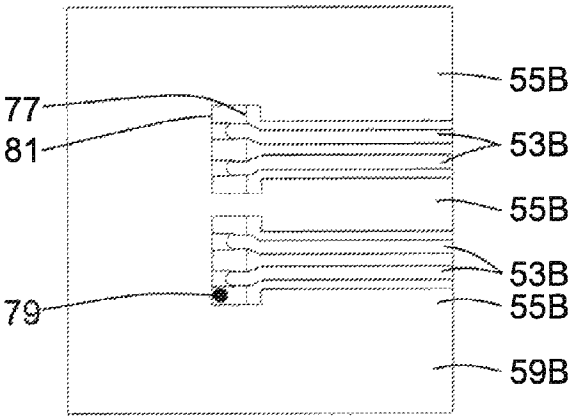
FIG. 22 is a bottom view of the conductive portions of the circuit board of FIG. 18.
Figure 21:
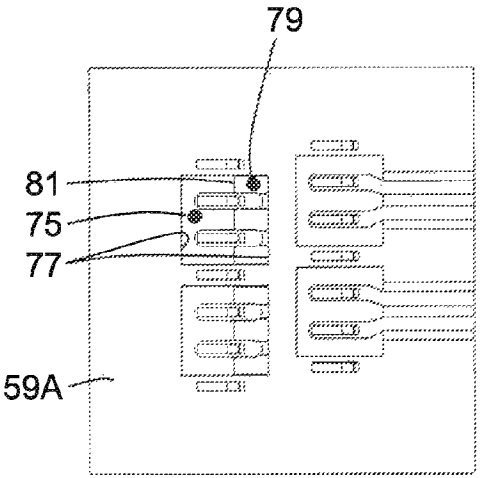
FIG. 21 is a top view of the conductive portions of the circuit board of FIG. 18.
Figure 18:
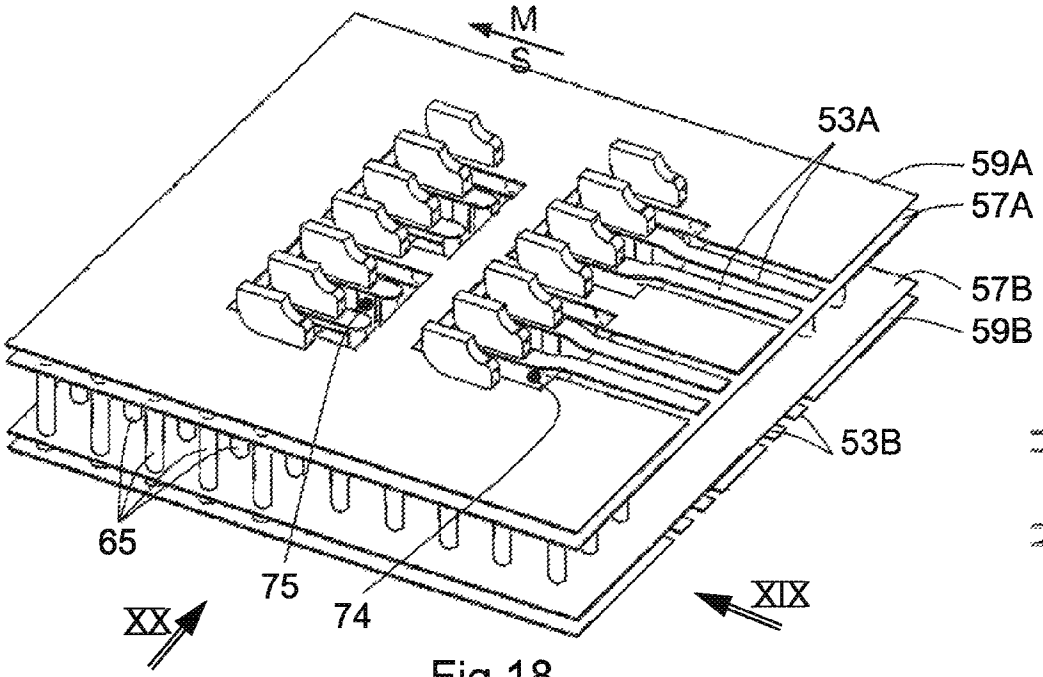
FIG. 18 is a perspective view of the conductive portions of a circuit board.
Figure 19:
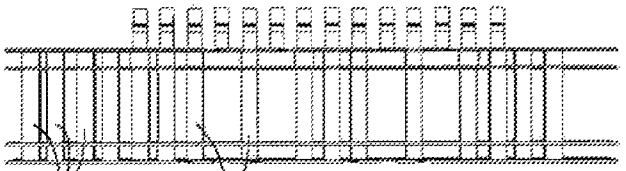
FIG. 19 is a front view of the conductive portions of the circuit board of FIG. 18 as indicated in FIG. 18 with XIX.
Figure 20:
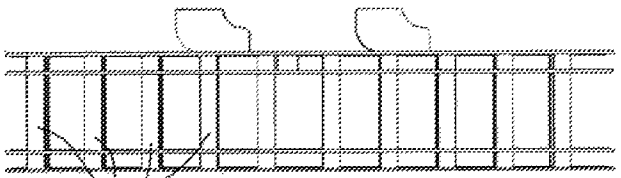
FIG. 20 is a side view of the conductive portions of the circuit board of FIG. 18 as indicated in FIG. 18 with XX.

FIGS. 8-10 show a connection portion of a circuit board 3 or contact card, comprising a plurality of signal conductor traces 33 and a plurality of ground traces 35 extending from a main portion towards an edge 37 at a circuit board mating side MS. FIG. 11 is a front view and FIG. 12 is a side view of the conductor geometry shown in FIG. 10 as indicated with the heavy arrows XI and XII, respectively. The circuit board comprises a circuit board connector portion 39 adjacent the first edge 37, which is the only portion shown in FIGS. 8-10. The circuit board connector portion 39 comprises signal contact pads 41 for contacting the signal conductor traces 33 with contacts of a mating connector, here contacts of terminals 11A, 11B of the connector 1 of any one of FIGS. 1-7, and ground contact pads 43 for contacting the ground traces 35 with contacts of the mating connector 1 (FIGS. 8, 9).

On the circuit board the contact pads 41-43 are spaced substantially equidistant in the direction of the edge 37, whereas the signal traces 33 are arranged closer to each other remote from the edge 37, so as to improve their characteristics for differential signalling (e.g. reduced surface area between the traces 33 reduces picking up different noise signals in the individual traces and closer coupling due to closer proximity).

Best visible in FIG. 9, the signal contact pads 41 are separated from the first edge 37 of the circuit board 3 by a first distance D1 and the ground contact pads 43 are separated from the first edge 37 by a second distance D2 which is smaller than the first distance D1. When inserting the circuit board 3 into the connector 1 (e.g. FIGS. 7, 8), the ground contact pads 43 and the corresponding terminals 11 will make contact before the signal contact pads 41 and the corresponding terminals 11 will, and the reverse when retracting the circuit board 3 from the connector 1; a first make—last break arrangement.

Further, inbetween the signal contact pads 41 and the first edge 37, the circuit board 3 comprises further contact pads 45 which are insulated from the signal contact pads 41 and which are separated from the first edge 37 by the second distance D2, which assist adapting the mating force profile of the circuit card 3 into a connector. Alternatively, the further contact pads 45 may extend towards the first edge 37 more or less far than the second distance D2 to provide a desired mating force profile of the circuit card 3 into a connector. In the shown embodiments, the further contact pads 45 are electrically floating, but they may be interconnected to each other, to a reference voltage and/or to ground.

The circuit board 3 of FIGS. 8-10 is a multilayered board and it comprises a plurality of ground layers 47 embedded in a dielectric carrier material 48. In this embodiment, the signal traces 33 and ground traces 35 remain on the upper and lower surfaces of the circuit board 3, at least in the board connection portion 39. Thus two sets are provided of adjacent signal conductor traces 33 and ground traces 35 each arranged on a common layer of the circuit board 3, which layers are on opposite surfaces of the circuit board 3.

Along the ground contact pads 43 and at least a portion of the ground traces 35 a plurality of conductive vias 49, e.g. plated holes or embedded conductors etc., are arranged adjacent each other to connect the ground pads 43 and ground traces 35 to the ground layers 47A, 47B. However, ground traces may also be connected to a single ground plane 47A or 47B, in which case the ground plane 47A, 47B nearest the particular ground trace 35 is preferred. The vias 49 here are substantially equidistant along the ground traces 35, each via 49 being arranged substantially in the middle of the width of the ground trace 35, 43 at the position of that via 49. The separation of the vias 49 along the traces corresponds to about one half and one quarter of otherwise expected noise wavelengths, preventing resonances at those wavelengths; other separations e.g. one third or one fifth are also envisioned.

Best visible in FIG. 10 is that the ground layers 47A, 47B extend substantially continuous across at least the connection portion 39 of the circuit board 3. However, both ground layers 47A, 47B comprise a window 51 defined by a perimeter 53 in the circuit board connector portion 39. The window 51 surrounds adjacent signal contact pads 41 when viewed normal to the circuit board 3 and ground layers 47.

In an embodiment schematically shown in FIG. 10A the circuit board 3 may comprise five layers arranged as an upper layer 59A comprising signal conductor traces 33A having signal contact pads 41A, an upper ground layer 47A, a middle ground layer 47C, a lower ground layer 47B and a lower layer 59B comprising signal conductor traces 33B having signal contact pads 41B, wherein the upper ground layer 47A and lower ground layer 47B each comprise a window 51A, 51B, surrounding at least one signal contact pad when viewed normal to that ground layer, whereas the middle ground layer 47C does not have a window at the position of the window 51A, 51B in the upper and/or lower ground layer 47A, 47B. In particular when a portion of the windows in the upper and lower ground layers overlap each other at least partially when viewed along their normal, the substantially continuous middle ground layer provides a shield against cross talk between signals on signal traces 33A, 33B and signal contact pads 41A, 41B, without compromising the impedance improvement caused by the windows 51A, 51B in the upper and lower ground layers 47A, 47B. The upper and lower layers 59A, 59B may comprise ground traces and ground pads (not shown).

FIGS. 13-17 show the conductive portions of a multilayered circuit board 5 comprising a plurality of signal conductor traces 53A, 53B, a plurality of ground traces 55A, 55B and a plurality of ground layers 57A, 57B. Additional traces 58A, 58B, are arranged between adjacent signal traces. These traces may float or be grounded which is preferred for reasons of cancelling noise, in particular when the signal traces 53A, 53B, are used for differential signal transmission. The ground traces 55A and 55B are interconnected to form substantially continuous ground layers 59A, 59B. The signal conductor traces 53A, 53B comprise signal contact pads 61A, 61B for contacting the signal conductor traces 53A, 53B to the rear ends 13A, 13B of the terminals 11A, 11B of the connector 1 which are partially shown and are indicated with 11A-G or 11B-G for ground, and 11A-S or 11B-S for signal (cf. FIGS. 1-6).

The signal traces 53A are arranged on the top layer of the circuit board 5. The signal traces 53B penetrate through the circuit board 5 with vias 63 and continue on the bottom layer. Likewise, the ground traces 55B penetrate through the circuit board 5 with vias 65 and continue on the bottom ground layer 59B. All vias 63, 65 extend along one row with the ground vias 65 separated by the signal vias 63.

In the upper ground layer 57A a window 67 defined by a perimeter 69 surrounds the signal contact pads 61B when viewed normal to the ground layer and a similar window 67 surrounds the signal contact pads 61B when viewed normal to the ground layer.

In the lower ground layer 57B a narrow window 71 defined by a perimeter 73 surrounds the signal vias 63. On the lower layer, each via 63 and each signal trace 53B are closely surrounded by ground traces 55B and additional traces 58B.

A further improved circuit board 5' is shown in FIGS. 18-22. This circuit board is substantially similar to that of FIGS. 13-17, with some variations. Some of the most important variations are the addition of a plurality of ground vias 65 adjacent each other and surrounding the signal vias 63 and the provision of a window 74 in the upper ground layer 57A surrounding the signal contact pads 61A when viewed normal to the layers. Further, a relatively large window 75 defined by a perimeter 77 is arranged in the upper ground layer 57A which surrounds the signal contact pads 61B when viewed normal to the ground layers, and a relatively smaller window 79 defined by a perimeter 81 in the structure on the lower layer 59B formed by the interconnected ground traces 55B. The windows 75 and 79 are offset and overlap in part. The impedance of the signal traces 53A and in particular the signal traces 53B are therewith significantly improved, as well as the integrity of signals transmitted through them, in particular differential signals.

Further, the additional traces 58A, 58B are removed and the signal traces 53A, 53B are arranged closer to each other, which reduces possible noise influences.

The invention is not restricted to the above described embodiments which can be varied in a number of ways within the scope of the claims. For instance, any connector may be shielded. The circuit boards may have more or less layers and/or be differently shaped. More, less and/or differently shaped traces may be provided.

Elements and aspects discussed for or in relation with a particular embodiment may be suitably combined with elements and aspects of other embodiments, unless explicitly stated otherwise.

The invention claimed is:

1. Circuit board comprising a plurality of signal conductor traces and a plurality of ground traces, a first edge towards a mating side, and a circuit board connector portion adjacent the first edge, wherein the circuit board connector portion comprises signal contact pads for contacting the signal conductor traces by contacts of a mating connector and ground contact pads for contacting the ground traces by contacts of the mating connector, wherein the signal contact pads are separated from the first edge of the circuit board by a first distance, wherein the ground contact pads are separated from the first edge of the circuit board by a second distance which is smaller than the first distance wherein inbetween the signal contact pads and the first edge the circuit board comprises one or more further contact pads which are insulated from the signal contact pads and which are separated from the first edge of the circuit board by a third distance, preferably substantially equal to the second distance.

2. Circuit board of claim 1 wherein the further contact pads are electrically floating.

3. Circuit board of claim 1 wherein the further contact pads are connected to one or more ground traces.

4. Multilayered circuit board comprising a plurality of signal conductor traces, a plurality of ground traces and one or more ground layers, wherein in at least a first portion of the circuit board at least a portion of the signal conductor traces and the ground traces are arranged adjacent each other, advantageously also substantially parallel to each other, wherein in the first portion of the circuit board the ground traces are connected to at least one ground layer with a plurality of adjacent conductive vias, wherein the one or more ground layers comprise an upper ground layer, a middle ground layer, and a lower ground layer, wherein the upper ground layer and the lower ground layer each comprise a window.

5. Multilayered circuit board of claim 4, wherein in the first portion of the circuit board the adjacent signal conductor traces and ground traces are arranged on a common layer of the circuit board.

6. Multilayered circuit board of claim 4, wherein the first portion of the circuit board comprises a circuit board connector portion comprising signal contact pads for contacting the signal conductor traces by contacts of a mating connector and ground contact pads for contacting the ground traces by contacts of the mating connector.

7. Multilayered circuit board of claim 4, wherein at least a portion of the conductive vias are separated by a mutual distance which corresponds to a predetermined fraction of a noise resonance wavelength.

8. Multilayered circuit board of claim 4, wherein the mutual separation of the vias varies along the adjacent and parallel signal conductor traces and ground traces.

9. Multilayered circuit board comprising a plurality of signal conductor traces and at least one ground layer, and a circuit board connector portion comprising signal contact pads for contacting the signal conductor traces by contacts of a connector, wherein the at least one ground layer comprises an upper ground layer, a middle ground layer, and a lower ground layer, wherein the upper ground layer and the lower ground layer each comprise a window, wherein the window of the upper ground layer or the lower ground layer is at the circuit board connector portion surrounding at least one signal contact pad when viewed normal to the at least one ground layer.

10. Multilayered circuit board of claim 9, wherein the window of the upper ground layer or the lower ground layer is at the circuit board connector portion surrounding a plurality of signal contact pads when viewed normal to the ground layer.

11. Multilayered circuit board of claim 4 being a multilayered circuit board further comprising a plurality of signal conductor traces and at least one ground layer, and a circuit board connector portion comprising signal contact pads for contacting the signal conductor traces by contacts of a connector, wherein the window of the upper ground layer or the lower ground layer is at the circuit board connector portion surrounding at least one signal contact pad when viewed normal to the at least one ground layer.

12. Circuit board of claim 1, being a multilayered circuit board further comprising a plurality of signal conductor traces, a plurality of ground traces and one or more ground layers, wherein in at least a first portion of the circuit board at least a portion of the signal conductor traces and the ground traces are arranged adjacent each other, advantageously also substantially parallel to each other, wherein in the first portion of the circuit board the ground traces are connected to at least one ground layer with a plurality of adjacent conductive vias.

13. Multilayered circuit board of claim 4, wherein the middle ground layer does not have a window at the position of the window of the upper ground layer and the window of the lower ground layer.

* * * * *